United States Patent [19]

Govindan

[11] 3,979,535

[45] Sept. 7, 1976

[54] PROCESS FOR THE SPRAY APPLICATION OF AQUEOUS PAINTS BY CONTROLLING THE TEMPERATURE OF THE AIR IN THE PAINT SPRAY ZONE

[75] Inventor: Tirunillayi S. Govindan, Wilmington, Del.

[73] Assignee: E. I. Du Pont de Nemours and Company, Wilmington, Del.

[22] Filed: July 30, 1975

[21] Appl. No.: 600,365

Related U.S. Application Data

[63] Continuation-in-part of Ser. No. 384,360, July 31, 1973, abandoned.

[52] U.S. Cl. ..... 427/422; 427/377; 427/409; 427/421

[51] Int. Cl.[2] ..... B05D 1/02

[58] Field of Search ..... 427/377, 409, 421, 422

[56] References Cited

UNITED STATES PATENTS

| | | | |
|---|---|---|---|
| 2,821,487 | 1/1958 | Hummel | 427/282 |
| 2,855,330 | 10/1958 | Griswold | 427/244 |
| 3,486,926 | 12/1969 | Rideout et al. | 428/156 |
| 3,598,770 | 8/1971 | Moore et al. | 260/2.5 |
| 3,625,727 | 12/1971 | Lightfoot et al. | 427/156 |
| 3,657,001 | 4/1972 | Parker | 427/388 |
| 3,661,827 | 5/1972 | Taft | 260/29.6 |
| 3,674,734 | 7/1972 | Parker | 428/334 |
| 3,787,230 | 1/1974 | Hoffman et al. | 260/873 |
| 3,790,513 | 2/1974 | Victorious | 307/115 |

OTHER PUBLICATIONS

*Advantages of Spraying with Heated Materials*, J. A. Weed, Metal Finishing, May 1959, pp. 70 and 71.

*Hot Spray Lacquering of Naval Airacraft*, W. A. Gottfried, Finish, Feb. 1954, pp. 29–31 and p. 82.

*The New York Times Complete Manual of Home Repair*, 1956, The MacMillan Company, pp. 252–253.

*Information Please Almanac*, 1971, Dan Golen Paul, pp. 766 and 767.

*Dry Steam Simplified Humidity Control In Color Spray Booths*, J. Schrantz, Industrial Finishing, Aug. 1972, pp. 45–47.

*Primary Examiner*—Michael R. Lusignan
*Assistant Examiner*—Shrive P. Beck

[57] ABSTRACT

The process is directed towards an improvement in the application of an aqueous paint to a substrate by air spraying the paint with a spray gun utilizing atomizing air at a flow rate of about 5–40 cubic feet per minute at an air pressure of 30–95 pounds per square inch at the spray gun and paint flow rate of about 5–30 ounces per minute, wherein the air atomized paint is applied to the substrate and baked to form a uniform finish on the substrate;

the improvement that is used with this process comprises spraying atomized paint in an atmosphere that is controlled at a temperature of about 15°–40°C. and at such a relative humidity that the air has a drive force value with the range of 0.002 to 0.004 humidity units (pounds of water/pound of dry air) which is constantly maintained at a set value within this range to initially dry the paint at a uniform rate to form a finish that has a uniform appearance after being baked;

the improved process is particularly useful for applying an exterior aqueous finish on automobile and truck bodies to form a high quality finish of uniform color, hue and appearance.

10 Claims, 1 Drawing Figure

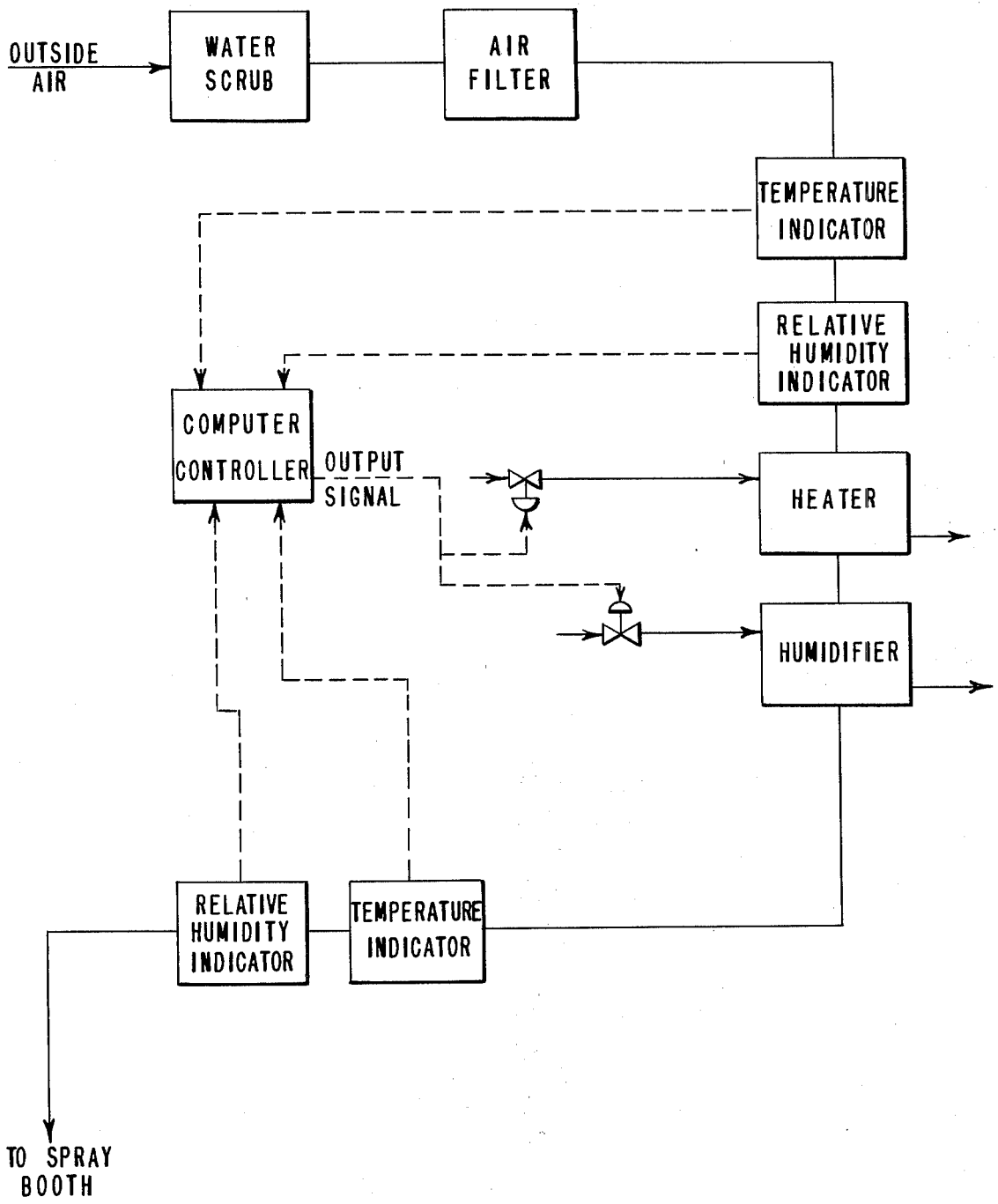
OUTSIDE AIR
WATER SCRUB
AIR FILTER
TEMPERATURE INDICATOR
RELATIVE HUMIDITY INDICATOR
COMPUTER CONTROLLER
OUTPUT SIGNAL
HEATER
HUMIDIFIER
RELATIVE HUMIDITY INDICATOR
TEMPERATURE INDICATOR
TO SPRAY BOOTH

PROCESS FOR THE SPRAY APPLICATION OF AQEOUS PAINTS BY CONTROLLING THE TEMPERATURE OF THE AIR IN THE PAINT SPRAY ZONE

CROSS REFERENCE TO RELATED APPLICATIONS

This application is a continuation-in-part application of Ser. No. 384,360 filed July 31, 1973 now abandoned.

BACKGROUND OF THE INVENTION

This invention relates to an improved process for applying aqueous coating compositions and in particular to an improved process for the application of thermosetting acrylic enamel coating compositions to provide finishes having a uniform appearance.

Thermosetting acrylic enamels are well known in the art as shown by Fraizer et al., U.S. Pat. No. 2,681,897, issued June 22, 1954; Vasta, U.S. Pat. No. 3,338,860, issued Aug. 29, 1967; Fisk et al., U.S. Pat. No. 3,365,414, issued Jan. 23, 1968; Vasta, U.S. Pat. No. 3,622,651, issued Nov. 23, 1971; Parker, U.S. Pat. No. 3,637,546, issued Jan. 25, 1972. These enamels are solvent based systems and the spray application of these enamels has not posed a problem. However, aqueous based acrylic enamels as illustrated by Taft, U.S. Pat. No. 3,661,827, issued May 9, 1972, Provide problems in drying of the finish during and after application. If the application is on a very humid day, the paint does not dry and runs and sags, and conversely, on very hot, dry days, the paint dries excessively as it is sprayed onto the panel, thereby giving a poor appearance. Also, variations in the humidity which do not cause difficulties in drying cause changes in the appearance of the paint film. In particular, paints containing metallic flakes, such as aluminum flakes, the appearance changes substantially under varying humidity conditions.

The improved process of this invention provides for initial drying conditions in which the air is under controlled temperature and humidity conditions which results in finishes that consistently have an excellent and uniform appearance without using conventional air conditioning, i.e., cooling of the air to reduce temperature and humidity.

SUMMARY OF THE INVENTION

The improved process of this invention is directed to the application of an aqueous paint to a substrate by air spraying the paint with a spray gun utilizing atomizing air at a flow rate of about 5–40 cubic feet per minute and at an air pressure of 30–95 pounds per square inch at the spray gun and a paint flow rate of 5–30 ounces per minute to form air atomized paint which then is applied to the substrate and subsequently baked at 75° to 200° C. to form a finish on the substrate;

the improvement used therewith comprises spraying the atomized paint in an atomosphere that is controlled at a temperature of about 15°–40°C. and at such a relative humidity that the air has a driving force value in the range of 0.002 to 0.004 humidity units which is constantly maintained at a set value within this range, thereby providing a uniform atmosphere for initially drying the aqueous paint during spraying to form a finish that has a uniform appearance after being baked.

BRIEF DESCRIPTION OF THE DRAWING

The FIGURE illustrates a schematic diagram for automatically adjusting the temperature and humidity of air in a paint spray booth.

DESCRIPTION OF THE INVENTION

In a conventional process for applying aqueous paints to a substrate by air spraying the paint, a spray gun it utilized which atomizes the paint to a fine spray to apply the paint to a substrate. Generally, the atomizing air is utilized at a flow rate of 5–40 cubic feet per minute and under a pressure of 30 to 95 pounds per square inch at the spray gun. The flow rate of paint passing through the gun is about 5–30 ounces per minute. The spray gun forms a uniform cone of air atomized paint which is applied to the substrate and subsequently the substrate is baked at about 75°–200°C. to provide a high quality finish. One preferred baking cycle for aqueous thermosetting acrylic enamels comprising a prebake at about 75°–95°C. for about 5–30 minutes and then a final bake at about 125°–200°C. to form the finish. The resulting finish is about 0.5–3.5 mils in thickness and preferably, 1.0–2.5 mils in thickness. Generally, these finishes can be rubbed or polished in accordance with conventional techniques to improve gloss.

This conventional spray application process provides adequate finishes under ideal drying conditions, for example, 25°C. and 50% relative humidity. However, problems arise under high humidity conditions, for example, relative humidity of 90% and above allows the aqueous finish to dry at a very slow rate and as a result, the finish has a poor appearance caused by sagging and running of the paint and also a color difference is often noted, and conversely under low relative humidity conditions such as 0–10% relative humidity, the atomized paint dries excessively while being sprayed onto the substrate and results in a gritty finish which has a poor appearance and also poor physical properties. Even under conditions which are conducive to drying, the finish produced from the aqueous paint has a different hue or shade and surface texture at various levels of relative humidity; in particular, this is most pronounced with paint containing metallic flake pigments.

The improved process of this invention economically provides a controlled air atmosphere for the initial drying of the finish which results in the uniform drying of the finish which is extremely important for the appearance of this finish. This is accomplished by controlling the air atmosphere at about 15°–40°C. and at such a relative humidity that the air has a driving force value in the range of 0.002 to 0.004 which is constantly maintained at a set value within this range. Preferably, the air has a driving force value of 0.003 humidity units.

The driving force value of the air is the humidity of the air corresponding to the adiabatic saturation temperature expressed in pounds of water per pound of dry air less the humidity of the ambient air also expressed in pounds of water per pound of dry air. These humidity values are determined with a standard humidity-temperature chart, for example, shown in John H. Perry's *Chemical Engineer's Handbook*, 4th Edition (McGraw Hill Chemical Engineering Series).

The following are typical examples where the drying air is controlled by either heating the air or by humidifying the air, for example, by the addition of steam or water:

| Ambient Air Temp. | Ambient Air R.H. | Driving Force Value Humidity Units (Lbs./Water/Lbs. Dry Air | Adjusted To Temp. | Adjusted To R.H. | Driving Force Value Of Adjusted Air Humidity Units (Lbs.Water/Lbs. Dry Air) | Process Step To Obtain Driving Force Value |
|---|---|---|---|---|---|---|
| 24°C. | 50% | 0.003 | — | — | — | |
| 24°C. | 20% | 0.005 | 24°C. | 50% | 0.003 | Add moisture by steam and water spray. |
| 24°C. | 90% | 0.0006 | 32°C. | 55% | 0.003 | Heat air. |
| 32°C. | 50% | 0.0035 | 31°C. | 54% | 0.003 | Add moisture by water spray. |
| 32°C. | 80% | 0.0014 | 37°C. | 60% | 0.003 | Heat air. |

The humidity of ambient air at a low relative humidity may be adjusted by the addition of steam or water or both. By proper choice of amount of steam and water, the air temperature can be adjusted. If the temperature of the ambient air is exceptionally high and the relative humidity low, water may be sprayed into the air to increase the humidity and also to lower the air temperature. If the ambient humidity is high, the air can be heated to such a temperature that the desired driving force for drying of the paint is achieved.

The spray process can be further controlled by heating the atomizing air from 40° to 150°C. which, of course, heats the paint on atomization and enhances the drying. This technique is particularly useful under high relative humidity conditions and increases the rate of drying of the paint during application thereby eliminating sagging and running of the paint.

The novel process of this invention is particularly advantageous in that it allows for a uniform spray application of the aqueous based paints under all types of relative humidity conditions and does not require the manufacturer to completely air condition a spray area. This technique reduces a manufacturer's initial costs and manufacturing costs since air conditioning equipment is not required. It is substantially more economical to heat or humidify or heat and humidify the air in the spray zone to control the evaporation than to air condition the entire spray area to a prescribed temperature and humidity. The novel process is particularly useful in the spray zones where the paint is applied by automatic machines.

Conventional air conditioning brings air to a fixed set of temperature and humidity conditions and uses one or a combination of the following steps heating, cooling, humidification and dehumidification to achieve these conditions and as pointed out is an expensive process. The process of this invention only uses heat and humidification and does not attempt to maintain constant temperature and humidity conditions as does air conditioning. The process of this invention maintains a constant driving force value so that the evaporation rate of the paint being sprayed remains at the same level to provide finishes with a uniform appearance.

The figure illustrates one practical system for controlling the temperature and humidity of the air fed into the controlled spray zone of a spray booth. Outside air is passed through a water scrubber to removed dust particles and clean the air. The air is next passed through a filter to remove any residual particles. A temperature indicator and a relative humidity indicator are positioned in the air line which are electrically connected to a computer controller which monitors the signal from the two indicators. The air passes through a heater and through a humidifier which are electrically or pneumatically coupled to the computer controller and controlled by the computer controller.

The heater is a conventional heat exchanger wherein the air is passed over a heated surface. Steam or hot water or another fluid can be used in the heat exchanger and the fluid flow is controlled by a valve that is electrically coupled to and controlled by the computer controller.

The humidifier can utilize a water spray or steam to increase the water content in the air. The humidifier is coupled to and controlled by the computer controller.

The air is then passed onto the portion of the spray boothe that is being automatically controlled. The air passes over a second set of temperature and humidity indicators electrically coupled to the computer controller. The computer controller receives the signals from the temperature and humidity indicators and utilizes the data to control the heater and humidifier.

The novel process of this invention can be utilized with a variety of aqueous based paints to improve the drying and appearance of the finish. Preferably, the novel process is utilized with aqueous thermosetting acrylic coating compositions and in particular thermosetting acrylic coating compositions in which the film-forming constituents comprise:

1. an acrylic polymer of styrene, methyl methacrylate or a mixture of styrene and methyl methacrylate, an alkyl acrylate or an alkyl methacrylate having 2–12 carbon atoms in the alkyl group, optionally a hydroxy alkyl acrylate or a hydroxy alkyl methacrylate and an $\alpha,\beta$-unsaturated carboxylic acid; and
2. a water-soluble or water-dispersible cross-linking agent.

One useful aqueous thermosetting acrylic enamel contains the following film-forming constituents:

1. 60–90% by weight of an acrylic polymer of
   a. 20–60% by weight of methyl methacrylate or styrene or a mixture of methyl methacrylate and styrene;
   b. 20–40% by weight of an alkyl having 2–12 carbon atoms in the alkyl group or an alkyl methacrylate having 4–12 carbon atoms in the alkyl group;
   c. 4–20% by weight of an $\alpha,\beta$-ethylenically unsaturated carboxylic acid such as acrylic acid, methacrylic acid or itaconic acid; and
2. 10–40% by weight of a water dispersible or water-soluble cross-linking resin such as an alkylated melamine formaldehyde resin having 1–4 carbon atoms in the alkyl group;

the composition contains sufficient basic compound to provide a pH of about 6–10.

One preferred aqueous thermosetting acrylic enamel coating composition utilized with the process of this invention comprises 10–60% by weight of film-forming constituents; wherein the film-forming constituents consist essentially of:

1. 60–90% by weight, based on the weight of the film-forming constituents, of an acrylic polymer having a uniformity factor of at least 75% which consists essentially of
   a. 20–60% by weight, based on the weight of the acrylic polymer, of a hard constituent which is either methyl methacrylate, or a blend of methyl methacrylate and styrene wherein the styrene comprises up to 40% by weight of the acrylic polymer;
   b. 20–40% by weight, based on the weight of the acrylic polymer, of a soft acrylic constituent that is either an alkyl acrylate having 2–12 carbon atoms in the alkyl group, an alkyl methacrylate having 4–12 carbon atoms in the alkyl group, or a mixture of the above alkyl acrylate and alkyl methacrylate;
   c. 4–20% by weight, based on the weight of the acrylic polymer, of a hydroxy-containing constituent which is either a hydroxyalkyl methacrylate or a hydroxyalkyl acrylate or a mixture thereof in which the alkyl groups have 2–4 carbon atoms,
   d. 4–20% by weight, based on the weight of the acrylic polymer of $\alpha,\beta$-unsaturated carboxylic acid;

wherein the polymer has a carboxyl to hydroxyl ratio of 1:0.2 to 1:1.8 and an acid number of about 35–150 and a weight average molecular weight of 5,000–80,000; and
2. 10–40% by weight, based on the weight of the film-forming constituent, of a water dispersible or water soluble cross-linking resin, preferably an alkylated melamine formaldehyde resin having 1–4 carbon atoms in the alkyl group; and the composition contains sufficient water-soluble amine to provide a pH of about 6–9.

The aforementioned coating composition is usually pigmented and contains about 0.1–40% by weight of pigment, but preferably, about 0.1–30% by weight of pigment. In particular, the composition can contain metallic flake pigments such as aluminum flake in amounts of 0.1–3.0% by weight. A variety of conventional pigments are utilized in the aformentioned compositions, such as metallic oxide, for example, titanium dioxide, iron oxide, zinc oxide and the like, metal hydroxides, metal powders, chromates, sulphates, carbonates, carbon black, silicate, talc, phthalocyanine blues and greens, indanthrone pigments and other organic pigments and dyes.

The water-dispersible or water-soluble cross-linking resin in the aforementioned enamel preferably is an alkylated melamine formaldehyde resin which is compatible with the acrylic polymer used in the enamel. Perferably, the enamel contains 65–85% by weight of the acrylic resin and 35–15% by weight of the alkylated melamine formaldehyde resin, and more preferably, about 70% by weight of the acrylic polymer is used in combination with about 30% by weight of an alkylated melamine formaldehyde resin.

Preferably, the alkylated melamine formaldehyde resins used in the aforementioned enamel have 1–4 carbon atoms in the alkyl group and are prepared by conventional techniques in which an alcohol, such as methanol, ethanol, propanol, isopropanol, butanol is reacted with the melamine formaldehyde resin. The melamine formaldehyde resin is reacted with isopropanol and is another useful resin. Also, urea formaldehyde resins can also be used as cross-linking agents.

The acrylic polymer used in the aforementioned enamel coating composition is partially soluble and partially dispersed in the aqueous medium. About 30–50% by weight of the acrylic polymer is dispersed and has a particle size of about 0.01–0.10 micron and preferably about 0.02–0.06 micron and the residual 50–70% by weight of the acrylic polymer is soluble and dissolved in the aqueous medium. To obtain water-solubility and dispersibility, the acrylic polymer preferably has a carboxyl to hydroxyl ratio of 1:0.2 to 1:1.8, which is the molar ratio of carboxyl groups to hydroxyl groups of polymer.

The acrylic polymer used in the aforementioned enamel composition has a uniformity factor of at least 75% and preferably 80–95%. The uniformity factor is the percent of polymer in which the constituents are in plus or minus 15% of the average amount given for the polymer. For example, if the average composition of the acrylic polymer is 54% methyl methacrylate, 34% butyl acrylate, 6% 2-hydroxyethyl acrylate and 6% acrylic acid; 75% of the polymer will be within plus or minus 15% of these average values or 54% plus or minus 8% methyl methacrylate, 34% plus or minus 5% butyl acrylate, 6 plus or minus 0.9% 2-hydroxyethyl acrylate and 6 plus or minus 0.9% acrylic acid.

The acrylic polymer utilized in the above composition is prepared by a programmed addition of the monomers, polymerization catalysts and solvents. This programmed addition process is an attempt to form polymer at all stages of the polymerization process which is essentially the same as the predetermined composition, and results in a polymer composition upon completion of the process which has a uniformity factor of at least 75%. This process allows for high percentage conversion of monomers to polymer and also provides a polymer having a relatively uniform molecular weight. These polymers, when used in the novel composition of this invention, provide high quality finishes.

Conventional polymerization processes, such as batch polymerization, commonly used in the art, provide polymers with a wide range of compositions and molecular weights which are not suitable for the novel coating composition of this invention.

The above programmed addition polymerization process is based on a computer program which uses known polymerization equations and activity ratios of monomers to determine the monomer addition rates and ratios and polymer polymerization temperatures and times. This forms a polymer that has a uniform composition throughout. The above programmed addition procedure can be based on a computer program which uses a polymerization equation in which the polymerization values of the monomers are used. In general, the programmed polymerization procedure comprises an initial charge of monomers and solvents which are heated to the reflux temperature in the polymerization vessel, then at given intervals monomers and polymerization initiator are charged into the vessel while maintaining a reflux temperature according to the programmed polymerization procedure. Throughout the polymerization reaction, the polymer being formed has a uniformity factor of at least 75%. In general, the polymerization is conducted at about 75°–125°C. over a 2–4 hour period to form a polymer that has a weight average molecular weight of about 5,000–80,000, and preferably, about 10,000–50,000 determined by gel permeation chromotography. The polymer has an acid number of about 35–150, preferably about 35–80.

Water-miscible solvents are used in the polymerization process to prepare the acrylic polymer, such as isopropanol n-propyl alcohol, 2-ethylhexanol, diacetone alcohol and other alcohols, acetone, acetyl acetone, ethylene glycol monoethylether, ethylene glycol monobutyl ether and ethylene glycol monomethyl ether acetate. Minor amounts of solvents of limited water solubility can be used, such as methylethyl ketone, ethylene glycol monoethyl ether acetate. The novel composition can contain up to about 20% by weight of water-miscible solvent but preferably contains 5–15% by weight of solvent. If desired, the novel composition may be made solvent free.

About 0.1–4% by weight, based on the weight of the monomer used to prepare the acrylic polymer, of the polymerization catalyst is utilized. Typical catalysts are azo-bis-isobutyronitrile, azo-bis-($\alpha,\gamma$-dimethylvaleronitrile), benzoyl peroxide, t-butyl peroxypivalate, t-butyl peracetate and the like. Chain transfer agents, such as lauryl mercaptan are also used.

The acrylic polymer contains 20–60% by weight of a hard constituent which can be methyl methacrylate or a mixture of methyl methacrylate and styrene; up to 40% by weight of the polymer can be styrene. The acrylic polymer can contain 5–30% by weight of styrene in combination with 15–30% by weight of methyl methacrylate. Preferably, the polymer contains about 52–57% by weight of methyl methacrylate.

The acrylic polymer contains 20–40% by weight of a soft acrylic constituent which is either an alkyl acrylate that has 2–12 carbon atoms in the alkyl group, an alkyl methacrylate having 4–12 carbon atoms in the alkyl group or a mixture of these two constituents. Preferably, the acrylic polymer contains 28–38% by weight of the soft acrylic constituent, preferably, an alkyl acrylate having 2–8 carbon atoms in the alkyl group. The following are typical soft acrylic monomers which can be utilized: ethyl acrylate, propyl acrylate, isopropyl acrylate, butyl acrylate, isobutyl acrylate, hexyl acrylate, 2-ethylhexyl acrylate, octyl acrylate, nonyl acrylate, lauryl acrylate and the like, butyl methacrylate, isobutyl methacrylate, pentyl methacrylate, hexyl methacrylate, octyl methacrylate, 2-ethylhexyl methacrylate, decyl methacrylate, lauryl methacrylate and the like. Butyl acrylate is the preferred soft acrylic constituent since it forms a high quality polymer that has excellent physical properties.

The acrylic polymer contains 4–20% by weight of a hydroxy containing constituent such as a hydroxy alkyl acrylate or a hydroxy alkyl methacrylate or a mixture of these two compounds. Preferably, the polymer contains about 5–10% of the hydroxyl containing constituent. These constituents contain 2–4 carbon atoms in the alkyl groups and are, for example, hydroxyethyl acrylate, hydroxybutyl acrylate, hydroxyethyl methacrylate, hydroxypropyl methacrylate and hydroxybutyl methacrylate.

The acrylic polymer also contains 4–20% by weight, based on the weight of the acrylic polymer, of an $\alpha$, $\beta$-unsaturated carboxylic acid. Typically useful acids are acrylic acid, methacrylic acid, crotonic acid, itaconic acid, propyl acrylic acid, and the like. Preferably, acrylic acid and methacrylic acid are used in amounts of 4–10% by weight since these acids form high quality polymers.

One preferred acrylic polymer used in this invention contains 50–60% by weight of methyl methacrylate, 30–40% by weight of a soft acrylic constituent, preferably butyl acrylate, 5–10% by weight of the hydroxy-containing constituent, preferably hydroxyethyl acrylate or hydroxypropyl methacrylate, and 4–12% by weight of acrylic acid, methacrylic acid, or itaconic acid. These preferred acrylic polymers have a weight average molecular weight of about 10,000–50,000, an acid number of about 35–100 and a carboxyl to hydroxyl ratio of about 1:1.03 to 1:1.5.

Another particularly useful acrylic polymer which gives a high quality finish contains about 28–32% by weight of styrene, 22–26% by weight of methyl methacrylate, 30–35% by weight of butyl acrylate, 7–9% by weight of hydroxy ethyl acrylate and 4–6% by weight of acrylic acid and has an acid number of about 30 to 50, a carboxyl to hydroxyl to hydroxyl ratio of 1:0.4 to 1:1.5 and a weight average molecular weight of about 10,000–50,000.

To form the aqueous dispersion, the acrylic polymer is at least partially neutralized with a water-soluble amine and then dispersed in water. Typical water-soluble amines that can be used are primary amines, secondary amines, tertiary amines, polyamines and hydroxyamines, such as ethanolamine, diethanolamine, triethanolamine, n-methylethanolamine, N,N-diethylethanolamine, N-aminoethanolamine, N-methyldiethanolamine, monosopropanolamine, diisopropanolamine, triisopropanolamine, hydroxyamine, butanolamine, hexanolamine, methyl diethanolamine, N,N-diethylaminoethylamine, ethylene diamine, diethylene triamine, diethylene tetramine, hexamethylene tetramine, triethylamine and the like. The acrylic polymer is usually 50–60% neutralized and can be 100% neutralized. Neutralization of 50–60% is preferred since this degree of neutralization forms an aqueous dispersion which permits enamel formulation at high solids. The pH of the resulting aqueous coating composition is generally adjusted to a pH of 6–9, preferably 7.1–7.5.

The novel process of this invention can be utilized to apply the paints over a variety of substrates such as metal, wood, glass, steel, iron, plastics, and the like. Preferably, the novel process is utilized for applying aqueous coatings over primed metal substrates. Typical alkyd primers and epoxy primers pigmented with iron oxide, carbon black, titanium dioxide are used. The primer can be applied on the metal by electrodeposition or can be applied by conventional spray or dipping techniques. The process can be utilized to provide coatings directly over galvanized steel to form a durable finish.

The preferred aqueous acrylic enamel can be applied directly over the primed metal substrates without the use of an intermediate sealer coat. However, a sealer coat can be used to provide a finish with excellent adhesion and smoothness. These sealers may be water based or solvent based. One typically useful sealer composition is disclosed in Rohrbacher, U.S. Pat. No. 3,509,086, issued Apr. 28, 1970.

Finishes applied by the novel process of this invention are characterized by a glossy, smooth and even finish that has a uniform appearance, that has excellent water spot resistance, craze resistance, good durability and weatherability and gloss retention and excellent gasoline resistance. These characteristics of the finish applied by the novel process of this invention makes the process particularly attractive for applying the exterior finishes on automobile and truck bodies.

The following Examples illustrate the invention. The parts and percentages are by weight unless otherwise specified.

EXAMPLE 1

A coating composition is prepared by first forming the following acrylic polymer dispersion:

| | Parts By Weight |
|---|---|
| Portion 1 | |
| Methyl methacrylate monomer | 17.080 |
| Butyl acrylate monomer | 19.130 |
| 2-Ethyl hexyl acrylate monomer | 2.720 |
| Acrylic acid monomer | 1.150 |
| Isopropanol | 6.140 |
| Ethylene glycol monobutyl ether | 9.680 |
| Lauryl mercaptan | 0.294 |
| Portion 2 | |
| Benzoyl peroxide | 0.672 |
| Methylethyl ketone | 1.580 |
| Ethylene glycol monomethyl ether acetate | 1.580 |
| Ethylene glycol monobutyl ether | 2.360 |
| Portion 3 | |
| Methyl methacrylate monomer | 24.530 |
| Butyl acrylate monomer | 11.520 |
| 2-Hydroxyethyl acrylate | 3.910 |
| Acrylic acid | 2.090 |
| Benzoyl peroxide | 0.906 |
| Isopropyl alcohol | 3.000 |
| Ethylene glycol monobutyl ether | 9.800 |
| Portion 4 | |
| Methyl methacrylate monomer | 25.720 |
| Butyl acrylate | 12.080 |
| 2-Hydroxyethyl crylate monomer | 4.090 |
| Acrylic acid monomer | 2.200 |
| Benzoyl peroxide | 1.248 |
| Isopropanol | 4.120 |
| Ethylene glycol monobutyl ether | 13.150 |
| Portion 5 | |
| Ethyl methacrylate | 9.570 |
| Butyl acrylate | 4.490 |
| 2-Hydroxyethyl acrylate | 1.520 |
| Acrylic acid monomer | 0.820 |
| Benzoyl peroxide | 0.440 |
| Isopropanol | 1.460 |
| Ethylene glycol monobutyl ether | 4.760 |
| Portion 6 | |
| Diethylethanolamine | 7.900 |
| Demineralized water | 101.300 |
| Portion 7 | |
| Demineralized water | 169.090 |
| Total | 492.100 |

Portion 1 is charged into a reaction vessel equipped with a stirrer, a heating mantle and a reflux condenser and then heated to the reflux temperature which is about 160°C. Portion 2 is premixed and then added and then Portion 3 is premixed and added at a uniform rate over a 20-minute period, while maintaining the reaction mixture at its reflux temperature. Portion 4 is premixed and added at a uniform rate over a 60-minute period while the reaction mixture is maintained at its reflux temperature. Portion 5 is premixed and added at a uniform rate over a 100-minute period, then the reaction mixture is maintained at its reflux temperature for an additional ½ hour. Portion 6 is premixed and then added to the reaction mixture and then Portion 7 is added to the reaction mixture and the reaction mixture is cooled to room temperature and filtered to remove any coagulum.

The resulting polymer dispersion has a 34% polymer solids content in which the particle size is about 0.02–0.06 microns. The polymer has a relative viscosity of 1.16 measured at 25°C. in dimethyl formamide at about 0.5% polymer solids and has an acid number of about 33 to 35 and a carboxyl to hydroxyl ratio of 1 to 1.5. The polymer has the following composition: methyl methacrylate/butyl acrylate/2-hydroxyethyl acrylate/acrylic acid in a weight ratio of about 54.2/33.1/8.4/4.3 and uniformity factor of about 75–85%.

A phthalocyanine blue mill base is prepared as follows:

| | Parts By Weight |
|---|---|
| Portion 1 | |
| Hexa(methoxymethyl) melamine | 546 |
| Isopropanol | 630 |
| Portion 2 | |
| Phthalocyanine blue pigment | 210 |
| Portion 3 | |
| Hexa(methoxymethyl) melamine | 285 |
| Isopropanol | 426 |
| Total | 2097 |

Portion 1 is mixed with Portion 2 over a 30 minute period and then Portion 3 is added and the constituents are mixed for 30 minutes. The resulting composition is passed through a standard sand mill and ground two passes to provide a uniform mill base.

A blue mill base is prepared as follows:

| | Parts By Weight |
|---|---|
| Portion 1 | |
| Hexa(methoxymethyl) melamine | 78 |
| Isopropanol | 90 |
| Portion 2 | |
| "Monastral" blue pigment | 30 |
| ortion 3 | |
| Hexa(methoxymethyl) melamine | 41 |
| Isopropanol | 61 |
| Total | 300 |

Portion 1 is mixed with Portion 2 over a 30-minute period and then Portion 3 is added and the constituents are mixed for 30 minutes. The resulting composition is passed through a standard sand-mill and ground for two passes to provide a uniform blue mill base.

A violet mill base is prepared as follows:

| | Parts By Weight |
|---|---|
| Portion 1 | |
| Hexa(methoxymethyl) melamine | 13.6 |
| Isopropanol | 45.1 |
| Portion 2 | |
| "Monastral" violet pigment | 7.0 |
| Portion 3 | |
| Hexa(methoxymethyl) melamine | 7.6 |
| Isopropanol | 26.7 |
| Total | 100.0 |

Portions 1 and 2 are blended together and then mixed for 30 minutes and then Portion 3 is added and the composition is mixed for an additional 15 minutes. The resulting composition is then ground two passes in a standard sandgrinding mill to form a uniform mill base.

A phthalocyanine green-yellow mill base is formed as follows:

| | Parts By Weight |
|---|---|
| Portion 1 | |
| Hexa(methoxymethyl) melamine | 78 |
| Isopropanol | 90 |
| Portion 2 | |
| Phthalocyanine green-yellow pigment | 30 |
| Portion 3 | |
| Hexa(methoxymethyl) melamine | 41 |
| Isopropanol | 61 |
| Total | 300 |

Portion 1 is blended with Portion 2 in a mixing vessel for 30 minutes and then Portion 3 is added and blended to an additional 15 minutes. The resulting composition is then ground two passes in a standard sandgrinding mill to form a uniform mill base.

An aluminum flake mill base is prepared as follows:

| | Parts By Weight |
|---|---|
| Aluminum flake | 1.71 |
| Hexa(methoxymethyl) melamine | 5.75 |
| Isopropanol | 11.05 |
| Total | 18.51 |

The above constituents are thoroughly blended together for 30 minutes to form a uniform dispersion.

A paint composition is prepared by blending together the following ingredients:

| | Parts By Weight |
|---|---|
| Portion 1 | |
| Phthalocyanine Blue mill base (prepared above) | 6.35 |
| Blue mill base (prepared above) | 0.20 |
| Violet mill base (prepared above) | 0.70 |
| Phthalocyanine green-yellow mill base (prepared above) | 0.45 |
| Aluminum flake mill base (prepared above) | 11.05 |
| Portion 2 | |
| Hexa(methoxymethyl) melamine | 20.40 |
| Portion 3 | |
| Acrylic polymer dispersion (prepared above) | 272.40 |
| Portion 4 | |
| Deionized water | 18.00 |
| Portion 5 | |
| Butyl acrylate/acrylic acid copolymer solution —(80% polymer solids in alcohol of an 85/15 butyl acrylate/acrylic acid copolymer) | 3.30 |
| Silicone anti-cratering agent solution (10% low molecular weight silicone resin in water) | 3.35 |
| Deionized water | 31.00 |
| Total | 367.10 |

Portion 1 is charged in a mixing vessel and thoroughly blended together and then Portion 2 is added then blended with Portion 1 and Portions 3, 4 and 5 are added consecutively with blending after each addition. The resulting composition has a 30 second viscosity using a No. 2 Fisher cup and a total solids content of 28.1%.

A Binks 62-A spray gun is used with a 63 PB cap, paint flow rate 16 ounces per minute, atomizing air pressure 70 psi. All spraying is done with an Eclipse automatic machine with an index speed set at 900 inches per minute travel. Four coats of paint are applied with two spray passes for each coat and with a 2 minute flash time between coats. The gun is positioned 14 inches from the panel. The panels are 4 × 6 inches of phosphatized steel primed with a 1.5 mil iron oxide pigmented alkyd resin primer. After application, each of the panels is baked for 15 minutes at 85°C. and then 45 minutes at 150°C.

Panels are sprayed under the following conditions:

| | Ambient Air | | | Controlled Air | | | |
|---|---|---|---|---|---|---|---|
| Panel Number | Temp. | R.H. | Driving Force Value | Temp. | R.H. | Driving Force Value | Panel Appearance |
| Control | 21°C. | 50% | 0.0027 | — | — | — | Good |
| 1 | 21°C. | 77% | 0.0010 | 27°C. | 55% | 0.0027 | Good |
| 2 | 27°C. | 85% | 0.0008 | 32°C. | 62% | 0.0027 | Good |
| 3 | 25°C. | 74% | 0.0014 | Not Controlled | | | Sagging and Running of Finish |
| 4 | 10°C. | 23% | 0.0027 | 18°C. | 45% | 0.0027 | Good |

EXAMPLE 2

A coating composition is prepared as follows:

| | Parts By Weight |
|---|---|
| Portion 1 | |
| Acrylic polymer dispersion (solids content of 70% and the polymer has a relative viscosity of about 1.09 measured at 25° in dimethyl formamide and about 0.5% polymer solids and an acid number of about 47 and a carboxyl to hydroxyl ratio of 1 to 0.58 and is of the following composition: methyl methacrylate/butyl acrylate/2-hydroxyethyl acrylate/acrylic acid in a weight ratio of about 54/34.2/5.7/6.1 and has a uniformity factor of about 75–85%) | 200 |
| Portion 2 | |
| Diethylaminoethanolamine | 14 |
| Portion 3 | |
| Deionized water | 318 |
| Portion 4 | |
| Hexa(methoxymethyl)melamine) | 60 |
| Total | 592 |

Portion 1 is charged into a mixing vessel and then Portion 2 is added and blended with Portion 1. Portion 3 is then slowly added with constant agitation. After Portion 3 is added, all of Portion 4 is then added and mixed in. The resulting coating composition has a solids content of about 33% and a spray viscosity of about 30 seconds using a No. 2 Parlin cup.

The above prepared coating composition is applied as in Example 1 using the identical spraying and baking procedures and the same primed steel panels under the same ambient air and controlled air conditions. The results of the application are very similar to the results of Example 1. The panels sprayed under uncontrolled conditions exhibited running and sagging.

EXAMPLE 3

A coating composition is prepared by blending the following ingredients:

| | Parts By Weight |
|---|---|
| Portion 1 | |
| Acrylic polymer dispersion (solids content of 71% and the polymer has a relative viscosity of 1.096 measured at 25°C. in dimethyl formamide at about 0.5% polymer solids, an acid number of about 93 to 94 and a carboxyl to hydroxyl ratio of 1 to 0.31 and is of the following composition: methyl methacrylate/butyl acrylate/hydroxyethyl acrylate/acrylic acid — 53.8/28.2/6.0/12.0 and has a uniformity factor of about 75–85%.) | 200 |
| Portion 2 | |
| Diethylaminoethanolamine | 15 |
| Portion 3 | |
| Deionized water | 318 |
| Portion 4 | |
| Hexa(methoxymethyl) melamine | 60 |
| Total | 593 |

Portion 1 is charged into a mixing vessel and then Portion 2 is added with constant agitation and then Portion 3 is slowly added to the reaction mixture and after Portion 3 has been added, Portion 4 is added and blended with the reaction mixture. The resulting composition has a 33% polymer solids content and a spray viscosity of 30 seconds measured in a No. 2 Parlin cup.

The above prepared coating composition is applied as in Example 1 using the identical spraying and baking procedures and the same primed steel panels under the same ambient air and controlled air conditions. The results of the application are very similar to the results of Example 1. The panels sprayed under controlled conditions have a good appearance while the panel sprayed under uncontrolled conditions exhibited running and sagging.

EXAMPLE 4

A paint composition is prepared by blending together the following ingredients:

| | Parts By Weight |
|---|---|
| Portion 1 | |
| Mill base (described in Example 1) | 6.35 |
| "Monastral" blue mill base (prepared in Example 1) | 0.20 |
| "Monastral" violet mill base (prepared in Example 1) | 0.70 |
| Phthalocyanine green-yellow mill base (prepared in Example 1) | 0.45 |
| Aluminum flake mill base (prepared in Example 1) | 11.05 |
| Portion 2 | |
| Hexa(methoxymethyl) melamine | 20.40 |
| Portion 3 | |
| Acrylic polymer dispersion (polymer solids content of 26% by weight and the polymer has a relative viscosity of about 1.15 measured at 25°C. in dimethyl formamide solvent at about 0.5% polymer solids, an acid number of about 46 to 47 and a carboxyl to hydroxyl ratio of 1 to 0.62 and the polymer is of the composition: methyl methacrylate/butyl acrylate/2-hydroxyethyl acrylate/acrylic acid in a weight ratio of about 54/34/6/6 and has a uniformity factor of about 75–85%) | 272.40 |
| Portion 4 | |
| Deionized water | 18.00 |
| Portion 5 | |
| Butyl acrylate/acrylic acid copolymer solution (described in Example 1) | 3.30 |
| Anti-cratering solution (10% silicone solution) | 3.35 |
| Deionized water | 31.00 |
| Total | 367.20 |

Portion 1 is charged into a mixing vessel and thoroughly blended together and then Portion 2 is added and blended and then Portion 3 is added and the constituents are thoroughly blended together. Portion 4 is added and blended with the mixture and then Portion 5 is added and thoroughly blended with the mixuture. The resulting paint composition has a 28% solids content and a spray viscosity of 31 seconds using a No. 2 Zahn cup.

The above prepared coating composition is applied as in Example 1 using the identical spraying and baking procedures and the same primed steel panels under the same ambient air and controlled air conditions. The results of the application are very similar to the results of Example 1. The panels sprayed under controlled conditions have a good appearance while the panel sprayed under uncontrolled conditions exhibited running and sagging.

The invention claimed is:

1. In a process for applying an aqueous dispersion or solution paint to a substrate by air-spraying the paint with a spray gun utilizing atomizing air at a flow rate of 5–40 cubic feet per minute and at an air pressure of 30–95 pounds per square inch at the spray gun and a paint flow rate of 5–30 ounces per minute which forms an air atomized paint spray which is applied to the substrate and baked at about 75° to 200°C. to form a uniform finish on the substrate, the improvement in use therewith comprising:

spraying the atomized paint in an air atmosphere that is controlled by the addition of steam or water at a temperature of 15°–40°C. and at such a relative humidity that the air has a driving force value in the range of 0.002 to 0.004 humidity units which is constantly maintained at a set value within this range, thereby providing an atmosphere for initally drying the aqueous paint during the spraying at a uniform rate to provide a finish that has a uniform appearance after being baked;

wherein the paint is an aqueous thermosetting acrylic enamel in which the film-forming constituents of the enamel comprise:

1. an acrylic polymer of styrene, methyl methacrylate or a mixture thereof, an alkyl acrylate or an alkyl methacrylate having 2–12 carbon atoms in the alkyl group, optionally a hydroxy alkyl acrylate or a hydroxy alkyl methacrylate and an $\alpha,\beta$-unsaturated carboxylic acid; and
2. a water soluble or water-dispersible cross-linking agent.

2. The process of claim 1 in which the air has a driving force value of 0.003 humidity units.

3. The process of claim 1 in which the acrylic enamel comprises 10 to 60% by weight of film-forming constituents and correspondingly 90 –40% by weight of water and up to 20% by weight of a solvent for the film-forming constituents; wherein the film-forming constituents consist essentially of:

1. 60–90% by weight, based on the weight of the film-forming constituents, of an acrylic polymer that consists essentially of:
   a. 20–60% by weight, based on the weight of the acrylic polymer, of a hard constituent which is either methyl methacrylate, styrene, or a blend of methyl methacrylate and styrene;
   b. 20–40% by weight, based on the weight of the acrylic polymer, of a soft constituent that is either an alkyl acrylate having 2–12 carbon atoms in the alkyl group or an alkyl methacrylate having 4–12 carbon atoms in the alkyl group or a mixture of the above acrylate and methacrylate;
   c. 4 to 20% by weight, based on the weight of the acrylic polymer, of a hydroxy containing constituent which is either a hydroxy alkyl methacrylate, or a hydroxy alkyl acrylate, or a mixture thereof in which the alkyl groups have 2–4 carbon atoms;
   d. 4–20% by weight, based on the weight of the acrylic polymer, of an $\alpha,\beta$-ethylenically unsaturated carboxylic acid;
2. 10–40% by weight, based on the weight of the film-forming constituents, of a water-dispersible alkylated melamine formaldehyde resin having 1–4 carbon atoms in the alkyl groups;

and the composition contains sufficient water-soluble amine to provide a pH of about 6–10.

4. The process of claim 3 in which the acrylic polymer of the enamel consists essentially of 50–60% by weight of methyl methacrylate, 30–40% by weight of butyl acrylate, 5–10% by weight of hydroxyethyl acrylate, and 4–12% by weight of acrylic acid and the polymer has an acid number of about 35–100 and a carboxyl to hydroxyl ratio of about 1:0.3 to 1:1.5, then the acrylic polymer has a weight average molecular weight of about 10,000–50,000.

5. The process of claim 3 in which the acrylic polymer of the enamel consists essentially of 28–32% by weight of styrene, 22–26% by weight of methyl methacrylate, 30–35% by weight of butyl acrylate, 7–9% by weight of hydroxyethyl acrylate, 4–6% by weight of acrylic acid and has an acid number of about 30–50 and a carboxyl to hydroxyl ratio of 1:0.4 to 1:1.5 and the polymer has a weight average molecular weight of about 10,000–50,000.

6. The process of claim 1 in which the atomizing air is heated to 40°C. to 150°C.

7. The process of claim 1 in which the spray gun is a hand spray gun.

8. The process of claim 1 in which the spray gun is an automatic spray gun.

9. The process of claim 1 in which the substrate is steel.

10. The process of claim 1 in which the substrate is a steel substrate coated with a primer composition.

* * * * *